US011814853B2

(12) United States Patent
Ufer

(10) Patent No.: US 11,814,853 B2
(45) Date of Patent: Nov. 14, 2023

(54) WINDOW WELL MOUNTING SYSTEM

(71) Applicant: Christopher Wade Ufer, Fort Collins, CO (US)

(72) Inventor: Christopher Wade Ufer, Fort Collins, CO (US)

( * ) Notice: Subject to any disclaimer, the term of this patent is extended or adjusted under 35 U.S.C. 154(b) by 95 days.

(21) Appl. No.: 17/648,910

(22) Filed: Jan. 25, 2022

(65) Prior Publication Data

US 2023/0094584 A1 Mar. 30, 2023

Related U.S. Application Data

(60) Provisional application No. 63/246,008, filed on Sep. 20, 2021.

(51) Int. Cl.
*E06B 1/12* (2006.01)
*E04F 17/06* (2006.01)
*E04C 2/08* (2006.01)

(52) U.S. Cl.
CPC ..... *E04F 17/06* (2013.01); *E04C 2/08* (2013.01); *E06B 1/12* (2013.01)

(58) Field of Classification Search
CPC ..... E06B 1/12; E04F 17/06
See application file for complete search history.

(56) References Cited

U.S. PATENT DOCUMENTS 3,703,791 A * 11/1972 Slade ..... E04F 17/06 52/107
5,918,430 A * 7/1999 Rowland ..... E06B 3/28 52/202
8,020,351 B2* 9/2011 Stephens ..... E06B 1/12 52/204.56
2021/0086011 A1* 3/2021 Dauman ..... A62C 99/0081

FOREIGN PATENT DOCUMENTS

DE 10164152 A1* 7/2003 ..... E04F 17/06

* cited by examiner

*Primary Examiner* — Christine T Cajilig
(74) *Attorney, Agent, or Firm* — Cochran Freund & Young LLC; Bridget A. Cochran

(57) ABSTRACT

Disclosed is a window well mounting system having a non-conductive bracket and a non-conductive seal that helps prevent premature oxidation of window wells. The non-conductive bracket and the non-conductive seal insulate conductive elements to stop the flow of electricity to the window well.

12 Claims, 8 Drawing Sheets

WINDOW WELL MOUNTING SYSTEM

CROSS-REFERENCE TO RELATED APPLICATION

This Non-Provisional Patent Application claims the benefit of the U.S. Provisional Pat. Application No. 63/246,008, entitled "Window Well Mounting System to Slow the Oxidation Process," which was filed with the U.S. Patent & Trademark Office on Sep. 20, 2021, which is specifically incorporated herein by reference for all that it discloses and teaches.

BACKGROUND

Window wells are an important part of the construction of houses and buildings because they allow for a point of egress and natural light to a basement area.

SUMMARY

An embodiment of the present invention may therefore comprise a method of installing a window well mounting system comprising: removing a portion of landscape from an area outside of a window well; disposing a window well having a left window well flange and a right window well flange in front of the narrow portion of the landscape; providing a left non-conductive bracket having a left first side with at least one left structure mounting hole and a left second side having at least one left window well mounting hole; providing a right non-conductive bracket having a right first side with at least one right structure mounting hole and a right second side having at least one right window well mounting hole; providing a left non-conductive seal; providing a right non-conductive seal; positioning the left first side of the left non-conductive bracket to a structure to be mounted so that the left second side of the left non-conductive bracket protrudes from the left first side of the left non-conductive bracket in a direction away from the structure and into an area inside the window well; drilling at least one hole through the structure that is aligned with the at least one left structure mounting hole of the left non-conductive bracket on the left first side of the left non-conductive bracket; positioning the right first side of the right non-conductive bracket to the structure to be mounted so that the right second side of the right non-conductive bracket protrudes from the right first side of the right non-conductive bracket in a direction away from the structure and into the area inside the window well, and the right non-conductive bracket being a distance from the left non-conductive bracket so that the left flange of the window well aligns with the left first side of the left non-conductive bracket and the right flange of the window well aligns with the right first side of the right non-conductive bracket; securing the left first side of the left non-conductive bracket to the structure with at least one left structure fastener by disposing the at least one left fastener through the at least one left structure mounting hole and into the structure; securing the right first side of the right non-conductive bracket to the structure with at least one right structure fastener by disposing the at least one right fastener through the at least one right structure mounting hole and into the structure; insulating the at least one left structure fastener from conducting electricity to the window well by securing the left non-conductive seal to the left first side of the left non-conductive bracket; insulating the at least one right structure fastener from conducting electricity to the window well by securing the right non-conductive seal to the right first side of the right non-conductive bracket; aligning the left window well with the left non-conductive bracket; aligning the right window well with the right non-conductive bracket; securing the window well to the left second side of the left non-conductive bracket by disposing the at least one left structure fastener through the at least one left window well mounting hole from an area inside the window well and through the window well; securing the window well to the right second side of the right non-conductive bracket by disposing the at least one right structure fastener through the at least one right window well mounting hole from the area inside the window well.

An embodiment of the present invention may further comprise a window well mounting system comprising: a left non-conductive bracket having a left first side with at least one left structure mounting hole, and a left second side with at least one left window mounting hole, and wherein the left second side of the left non-conductive bracket protrudes from the left first side of the left non-conductive bracket towards an area inside of the window well; a right non-conductive bracket having a right first side with at least one right structure mounting hole, and a right second side with at least one right window mounting hole, and wherein the right second side of the right non-conductive bracket protrudes from the right first side of the right non-conductive bracket towards the area inside of the window well; at least one left structure fastener disposed through the at least one left structure mounting hole and into a structure; at least one right structure fastener disposed through the at least one right structure mounting hole and into the structure; a left non-conductive seal disposed on the left first side of the left non-conductive bracket; a right non-conductive seal disposed on the right first side of the right non-conductive bracket; at least one left window well fastener disposed through the at least one left window well mounting hole from an area inside the window well and into the structure; at least one right window well fastener disposed through the at least one right window well mounting hole from an area inside the window well and into the structure.

BRIEF DESCRIPTIOPN OF THE DRAWINGS

DETAILED DESCRIPTION OF THE EMBODIMENTS

Figure 1A:
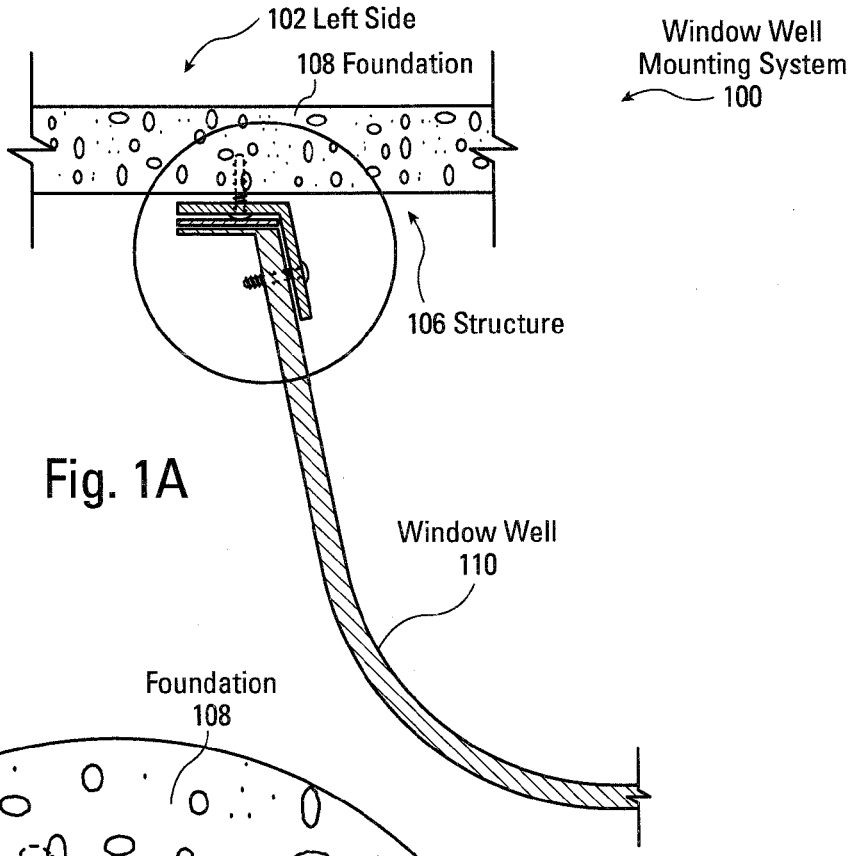
FIG. 1A is a top cross-sectional view of a left side of a window well mounting system.
Figure 1B:
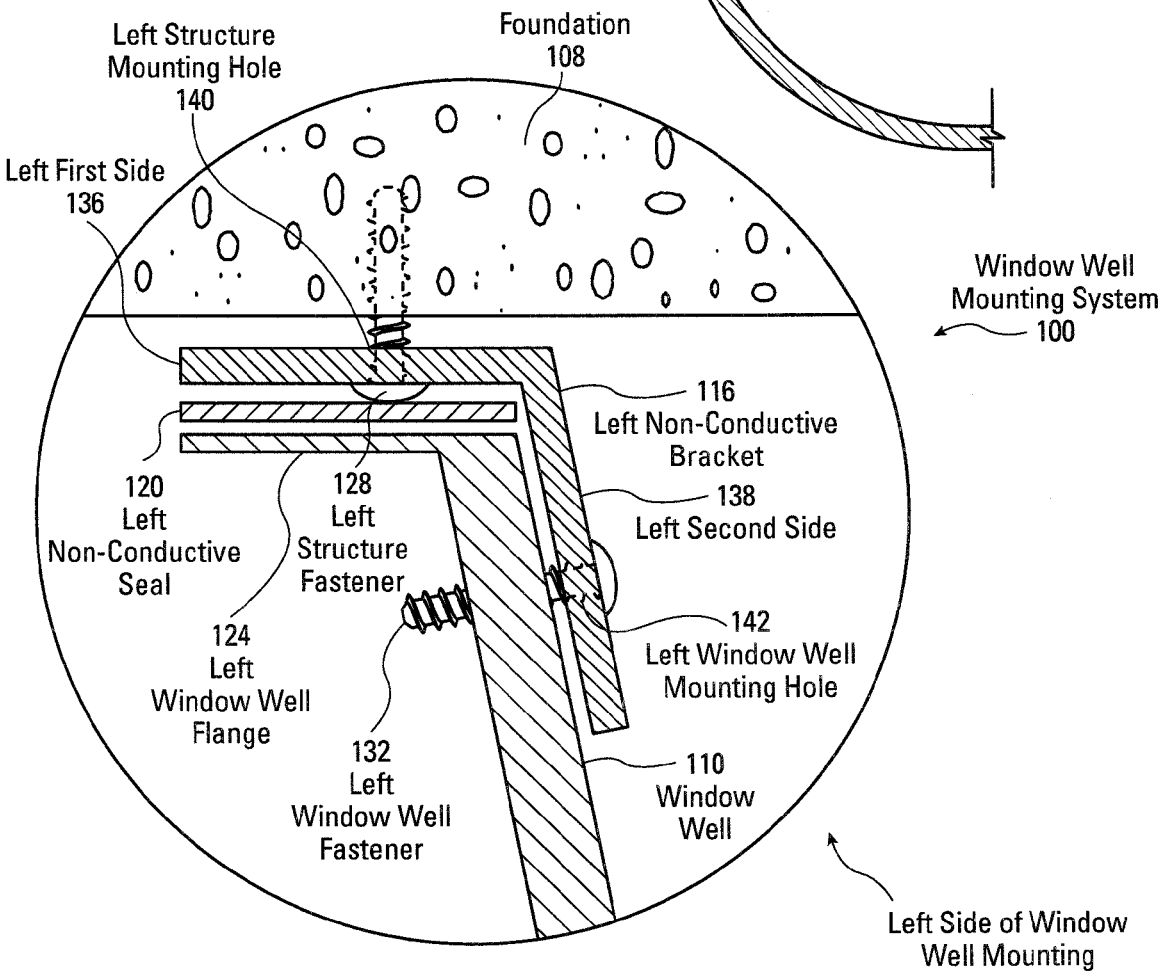
FIG. 1B is a cut away view of FIG. 1A.
Figure 6:
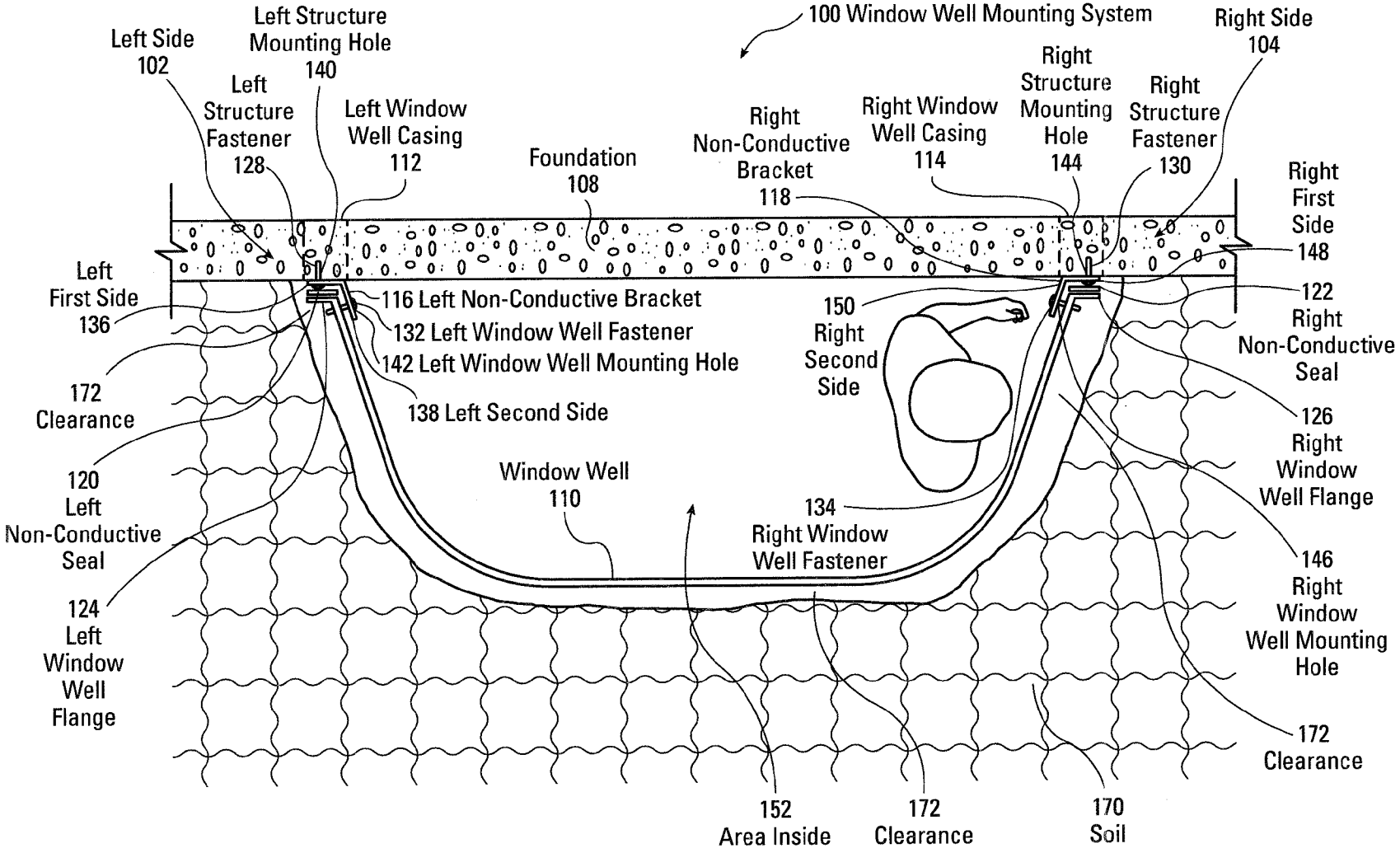
FIG. 6 is a top view of a window well being installed.
Figure 7:
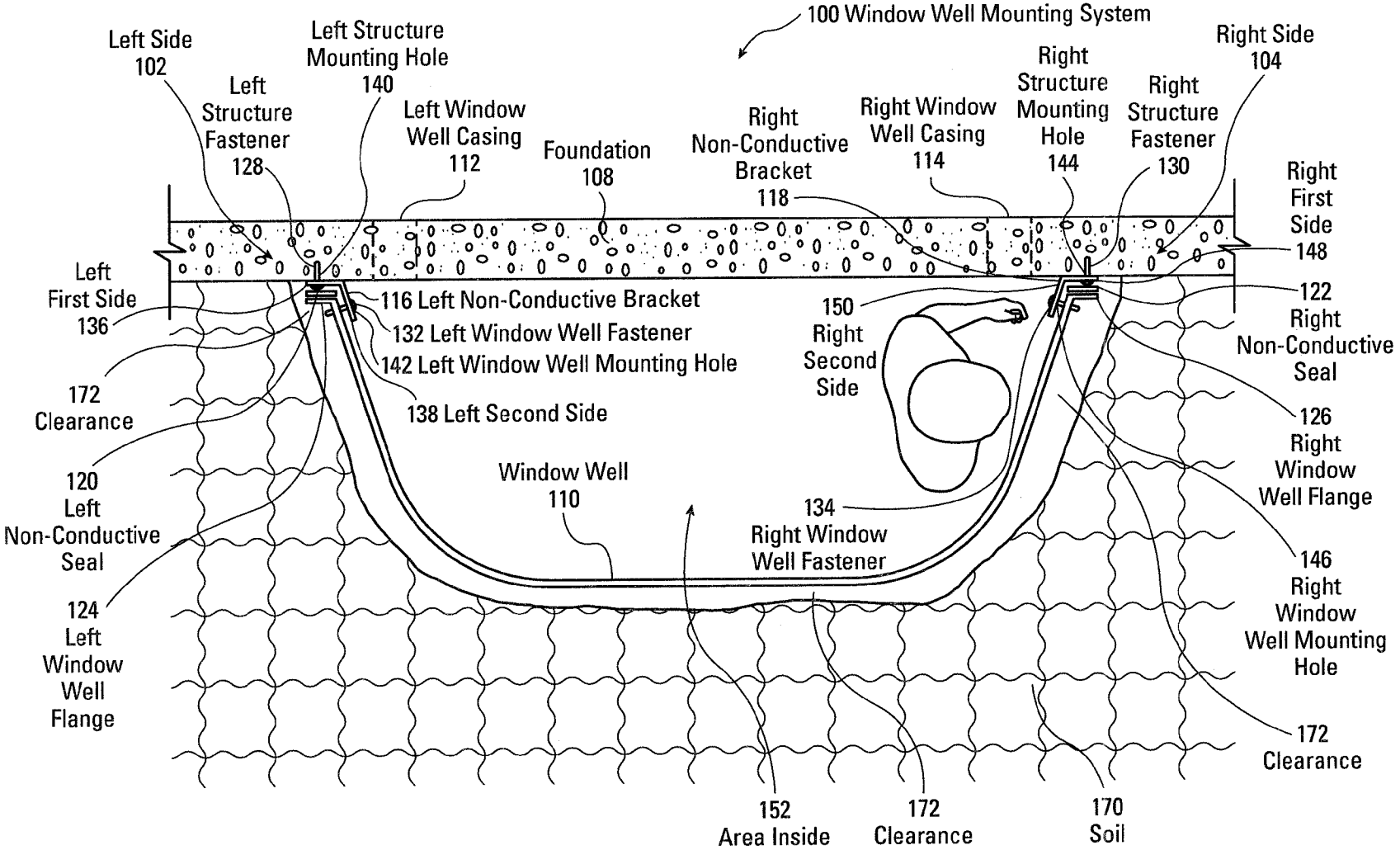
FIG. 7 is a top view of another embodiment a of a window well being installed.

FIGS. 1A and 1B are a top cross-sectional view and a cut away view of a left side 102 of window well mounting system 100. The entire window well mounting system 100 is shown in FIGS. 6 and 7 having a left side 102 and a right side 104 that attach a window well 110 to a structure 106 such as a house or building. FIG. 1A shows the left side 102 of window well 110 attached to a foundation 108 of a structure 106. FIG. 1B further illustrates left side 102 attached to the foundation 108 by securing a left first side 136 of a left non-conductive bracket 116 with a left structure fastener 128 through a left structure mounting hole 140 and into foundation 108. A left non-conductive seal 120 is located between the left non-conductive bracket 116 and a left window well flange 124 of the window well 110 so that left structure fastener 128 is not in contact with the left window well flange 124. Left window well fastener 132 attaches the window well 110 to a left second side 138 of the left non-conductive bracket 116 via a left window well mounting hole 142. As shown in FIG. 1B, left second side 138 of the left non-conductive bracket 116 protrudes from the left first side 136 of left non-conductive bracket 116 so that the left second side 138 can attach to the side of window well 110 while the left first side 136 abuts the structure 106 and is aligned with the left window well flange 124. It should be noted that the right side 104 (FIGS. 6 and 7) of window well mounting system 100 is constructed in the same manner as, and has the same components as, the left side 102 of window well mounting system 100 (as illustrated in FIGS. 6 and 7).

The left non-conductive bracket 116 and the right non-conductive bracket 118 (FIGS. 6 and 7) are made of non-conductive material that does not conduct electricity and has the strength and structural integrity to ensure the window well 110 is firmly secured to structure 106. Examples of non-conductive materials used for the left and right non-conductive brackets 116, 118 are materials such as: fiberglass, carbon fiber, reinforced plastics, or other natural and synthetic materials known in the art. The left non-conductive bracket 116 and the right non-conductive bracket 118 (FIGS. 6 and 7) act as insulators by preventing electricity from traveling from the structure 106 to the window well 110. In other words, the left non-conductive bracket 116 and the right non-conductive bracket 118 (FIGS. 6 and 7) prevent the window well 110 from being electrically connected to the structure 106. Additionally, the left non-conductive seal 120 and the right non-conductive seal 122 (FIGS. 6 and 7) are made of a non-conductive material that prevents electricity from flowing from the left structure fastener 128 and the right structure fastener 130 (FIGS. 6 and 7) to the window well 110.

Concrete-Encased Electrodes can function as a means of grounding an electrical system, such as the electrical system in a house or building. The moisture in the foundation 108 and rebar in the foundation acts as a conductor. If the metal window well 110 is in electrical contact with the foundation 108 and/or the Concrete-Encased Electrode, the window well 110 can oxidize prematurely as a result of electricity flowing through the metal of the window well 110. Additionally, if the metal window well 110 or the structure fasteners 128, 130 (FIGS. 6 and 7) going through the window well 110 are in contact with steel of a metal window buck or a steel reinforcing bar in the concrete, electricity can flow through the window well 110. In other words, moisture in contact with the two dissimilar metals/alloys can cause electrolysis, therefore causing premature oxidation of the window well 110. The left and right non-conductive seals 120, 122 (FIGS. 6 and 7) electrically insulate left and right structure fasteners 128, 130 (FIGS. 6 and 7) from conducting electricity to the left and right window well flanges 124, 126 (FIGS. 6 and 7) of window well 110 while also creating a watertight seal between the non-conductive brackets 116, 118 and the window well flanges 124, 126 (FIGS. 6 and 7) of window well 110. In other words, left and right non-conductive seals 120, 122 (FIGS. 6 and 7) ensure the window well 110 and the structure fasteners 128, 130 (FIGS. 6 and 7) are not electrically connected, while also providing a watertight seal between the window well 110 and the foundation 106. Left and right non-conductive seals 120, 122 (FIGS. 6 and 7) are made of a compressible material that does not conduct electricity and has a strength sufficient to remain intact while covering left and right structure fasteners 128, 130 (FIGS. 6 and 7). Examples of materials used for left and right non-conductive seals 120, 122 (FIGS. 6 and 7) are materials such as: dense foam rubber, natural rubber, other natural and synthetic materials, or other materials known in the art.

Figure 2:
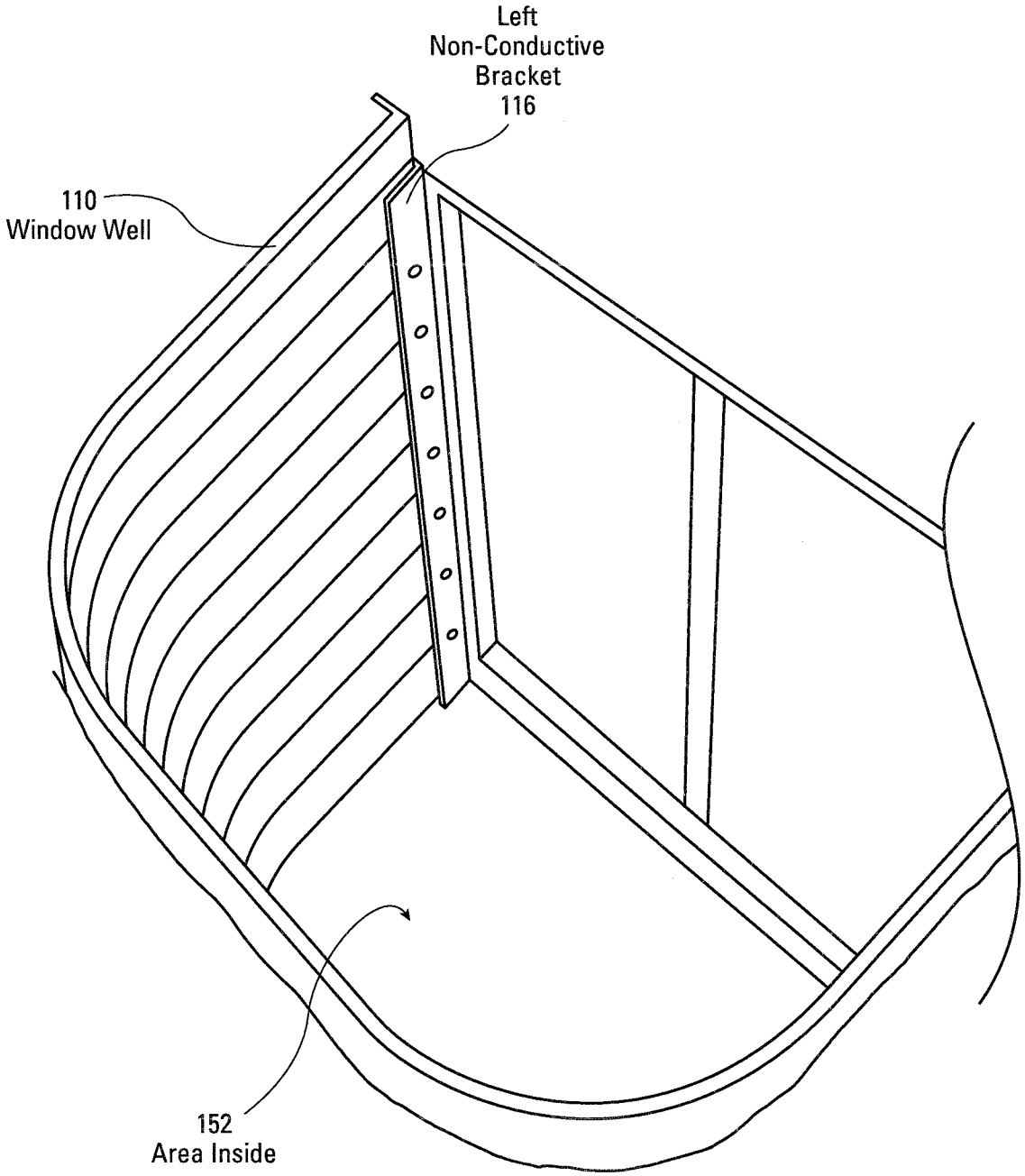
FIG. 2 is a top isometric view of the installed window well mounting system.

Both the left and right non-conductive seals 120, 122 and the left and right non-conductive brackets 116, 118 (FIGS. 6 and 7) can be manufactured by extrusion, mold casting, or other methods known in the art. It should be noted that multiple left and right non-conductive brackets 116, 118, multiple left and right non-conductive seals 120, 122, multiple left and right multiple structure fasteners 128, 130, and multiple left and right window well fasteners 132, 134 (FIGS. 6 and 7) may be employed as needed. For example, multiple left or right non-conductive brackets 116, 118 may be used on a single side of the window well and stacked if a left or right non-conductive bracket 116, 118 provided is not long enough to reach the bottom of the window well 110. In that case, multiple left and right non-conductive seals 120, 122 (FIGS. 6 and 7) can be used to cover the length of an additional left or right non-conductive bracket 116, 118 and electrically insulate the additional left or right structure fasteners 128, 130 from conducting electricity to window well 110. Non-limiting examples of left and right structure fasteners 128, 130, and left and right window well fasteners 132, 134 (FIGS. 6 and 7) are screws, nails, nuts and bolts, anchors, rivets, adhesive, or any other type of fastener known in the art. Left and right structure fasteners 128, 130, and left and right window well fasteners 132, 134 (FIGS. 6 and 7) are preferably made of a non-corrosive material having sufficient strength to secure the left and right non-conductive brackets 116, 118 (FIGS. 6 and 7) to structure 106 and to window well 110., FIG. 2 is a top isometric view of the installed window well 110 using the window well mounting system 100 (FIGS. 6 and 7) and further illustrating an area inside 152 of the window well 110 and the left non-conductive bracket 116.

Figure 3:
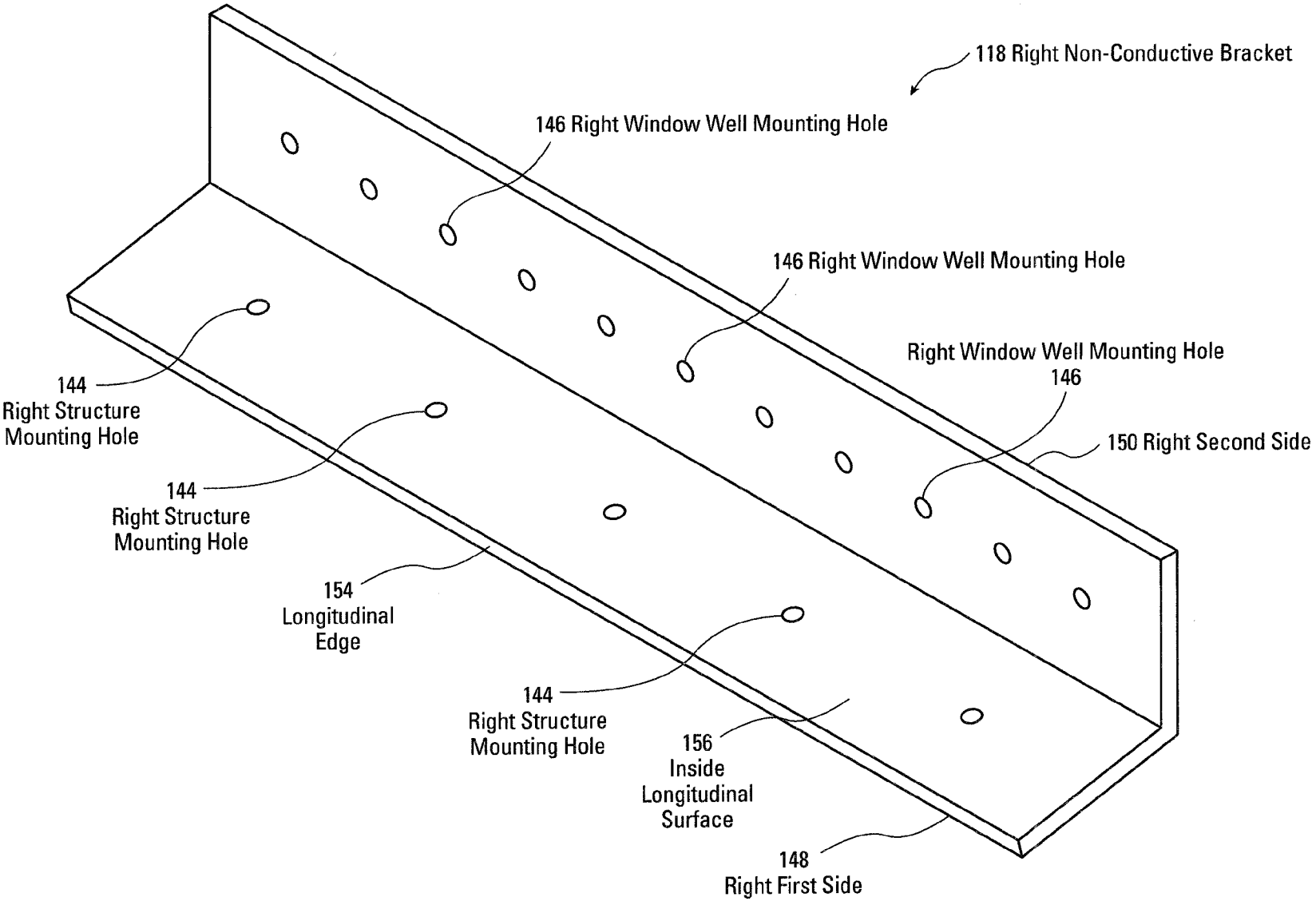
FIG. 3 is an isometric side view of a non-conductive bracket.

FIG. 3 is an isometric view showing a right non-conductive bracket 118 that is similar to the left non-conductive bracket 116 shown in FIG. 1A, except the right non-conductive bracket 118 is used on the right side 104 of the window well mounting system 100 (FIGS. 6 and 7). In other words, the left non-conductive bracket 116 (FIG. 1B) and the right non-conductive bracket 116 are constructed the same but facing opposite directions as shown in FIGS. 6 and 7. Similar to FIG. 1A showing left first side 136 of left non-conductive bracket 116 secured to structure 106, FIG. 3 shows right non-conductive bracket 118 having at least one right structure mounting hole 144 used to mount a right first side 148 to structure 106 (FIG. 1A), and right second side 150 having at least one right window well mounting hole 146 used to mount the window well to the right second side 150. Similar to the left non-conductive bracket 116 shown in FIG. 1A, right second side 150 protrudes from the right first side 148 so that the right first side 148 abuts and is mounted to structure 106 (FIG. 1A) while right second side 150 protrudes from structure 106 in a manner so that right second side 150 mounts the window well 110 to the right second side 150 of right non-conductive bracket 118

(FIGS. 6 and 7). FIG. 3 also shows right first side 148 having a longitudinal edge 154, and an inside longitudinal surface 156 that extend along the length of the right non-conductive bracket 118. Both the left and right non-conductive brackets 116, 118 can be manufactured as a single unitary piece, or as separate pieces and attached to each other.

Figure 4:
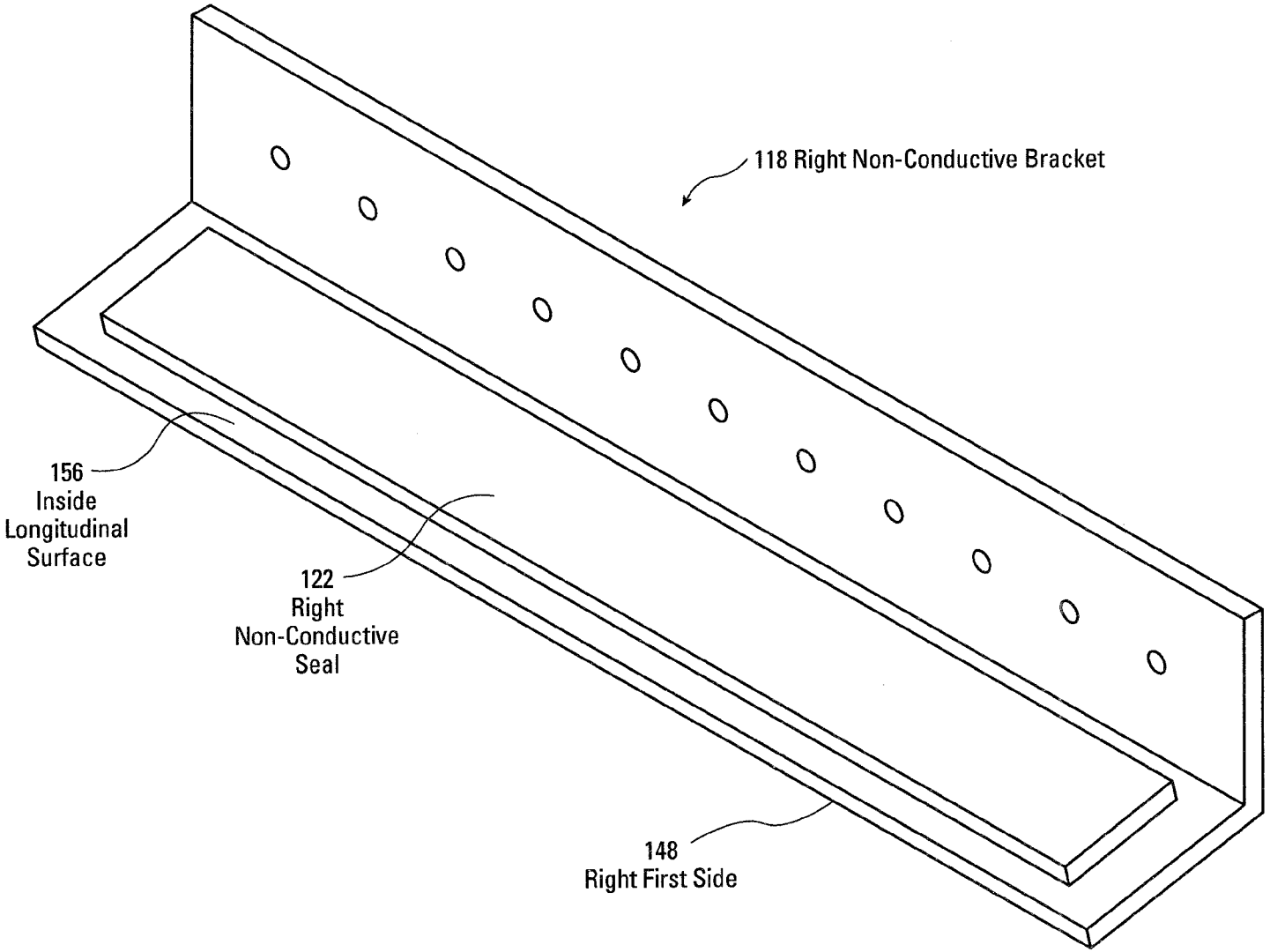
FIG. 4 is an isometric side view of FIG. 3 with a non-conductive seal.

FIG. 4 is an isometric view of right non-conductive bracket 118 having a right non-conductive seal 122 disposed on the inside longitudinal surface 156 that extends along the longitudinal length of right non-conductive bracket 118 to cover and electrically insulate right structure fasteners 130 from right window well flange 126 (FIGS. 6 and 7). It should be noted that FIG. 4 is only an illustration of the right non-conductive seal 122 being disposed on the right non-conductive bracket 118, and the left non-conductive seal 120 can also be secured to the left non-conductive bracket 116 (FIG. 1B) in the same manner as the right non-conductive bracket 118. Right and left non-conductive seals 120, 122 (FIGS. 6 and 7) can be attached to either one of the left or right non-conductive brackets 116, 118 by using adhesive, or by other methods as known in the art.

Figure 5:
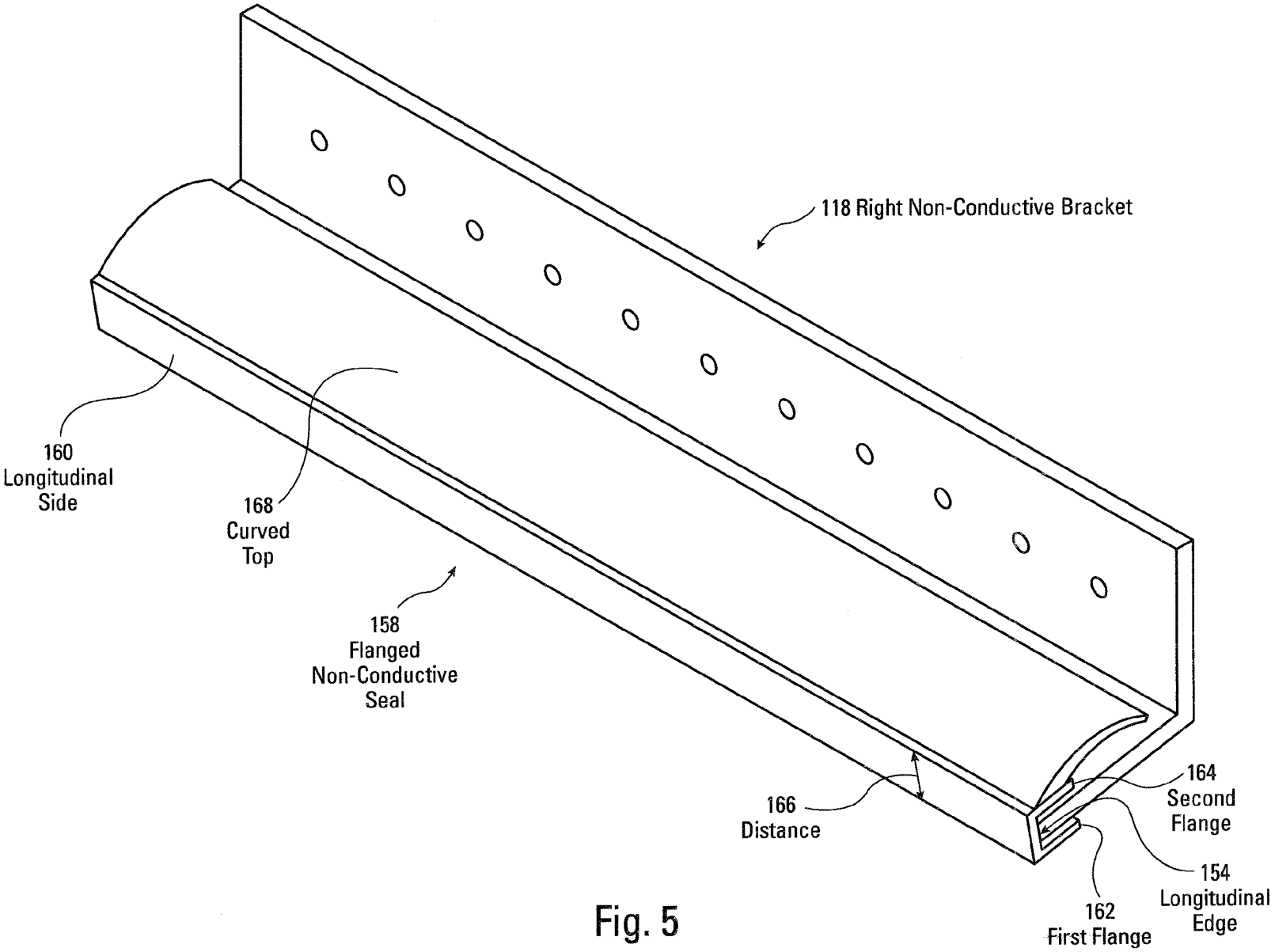
FIG. 5 is an isometric side view of FIG. 3 with a flanged non-conductive seal.

FIG. 5 is an isometric view of an alternative embodiment of a right non-conductive seal 122 shown in FIG. 4. FIG. 5 Illustrates a flanged non-conductive seal 158 having a longitudinal side 160 that extends along the length of right first side 148 (FIG. 3) of right non-conductive bracket 118. The longitudinal side 160 of the flanged non-conductive seal 158 has a first flange 162 and a second flange 164 that are located on opposing sides of each other separated by a distance 166 along the longitudinal side 160. First flange 162 and second flange 164 each protrude from the longitudinal side 160 along the length of the longitudinal side 160 so that the longitudinal edge 154 of the right first side 148 (FIG. 3) of the right non-conductive bracket 118 is sandwiched between the first flange 162 and the second flange 164 of the flanged non-conductive seal 158. The first flange 162 and the second flange 164 are connected to the longitudinal side 160 so that the first flange 162, the second flange 164, and the longitudinal side 160 extend along the length of the right first side 148 (FIG. 3) of the right non-conductive bracket 118. The first flange 162 and the second flange 164 assist in ensuring that the longitudinal edge 154 of the right first side 148 (FIG. 3) of the right non-conductive bracket 118 remains secured between the first flange 162 and the second flange 164 of the flanged non-conductive seal 158. The flanged non-conductive seal 158 also has a curved top 168 connected to the second flange 164. The curved top 168 is flexible and helps ensure a watertight seal is formed between the right window well flange 126 (FIGS. 6 and 7) and the right non-conductive bracket 118. Curved top 168 also ensures that right structure fastener 130 (FIGS. 6 and 7) is electrically insulated from conducting electricity to window well 110 (FIGS. 6 and 7). It should be noted that FIG. 5 is only an illustration of the flanged non-conductive seal 158 being disposed on the right non-conductive bracket 118, and the flanged non-conductive seal 158 can also be secured to the left non-conductive bracket 116 (FIG. 1B) in the same manner as the right non-conductive bracket 118. The flanged non-conductive seal 158 can be secured to either the left or right non-conductive bracket 116, 118 (FIGS. 6 and 7) in multiple ways such as: properly sizing the first flange 162 and the second flange 164 to securely fit the longitudinal edge 154 of the left or right first side 136, 138 (FIGS. 6 and 7), using adhesive, or by other methods known in the art. The flanged non-conductive seal 158 can be manufactured as a single unitary piece, or as separate pieces and attached to each other. It should be noted that the seal may be of other various shapes or forms that provide insulation to prevent left and right structure fasteners 128, 130 from conducting electricity to the window well 110 (FIGS. 6 and 7). As a non-limiting example, curved top 168 of the flanged non-conductive seal 158 could be a triangular pointed shape, polygonal, flat, or other shapes that create a watertight seal, and electrically insulate left and right structure fasteners 128, 130 from window well 110 (FIGS. 6 and 7).

FIG. 6 is a top view of a window well 110 being installed using the window well mounting system 100 directly attached to a left window well casing 112 and a right window well casing 114 that are attached to foundation 108. As previously discussed, window well mounting system 100 has left side 102 and right side 104. To install the window well 110, soil 170 (or other landscaping) is removed to provide a clearance 172 for the window well 110 to be disposed in a position ready for mounting. Clearance 172 around the perimeter of the window well 110 is created wide enough to fit the left and right non-conductive brackets 116, 118 and so that there is space to secure the left and right structure fasteners 128, 130 on the left and right non-conductive brackets 116, 118. If a fitted type of seal is being used such as the flanged non-conductive seal 158 in FIG. 5, then the flanged non-conductive seal 158 should be disposed on the left first side 136 of the left non-conductive bracket 116, and the right first side 148 of the right non-conductive bracket 118. The left non-conductive bracket 116 is positioned so that the left first side 136 is against the surface of the left window casing 112, and holes are drilled into the left window casing 112 that align with each left structure mounting hole 140. The right non-conductive bracket 118 is positioned against right window casing 114, and holes are drilled into the right window casing 114 that align with each right structure mounting hole 144. Left and right structure fasteners 128, 130 are then secured into each of left and right structure mounting holes 140, 144. It should be noted that the number of left and right structure mounting holes 140, 144 and the number of left and right structure fasteners 128, 130 can vary from a single structure mounting hole 140, 144 and a single structure fastener 128, 130 located approximately halfway down the depth of the window well 110, to multiple structure mounting holes 140, 144 and multiple structure fasteners 128, 130 used along the length of the window well depth.

As also shown in FIG. 6, the left first side 136 is secured to the left window casing 112 using left structure fastener 128 through left structure mounting hole 140 on the left non-conductive bracket 116 and into the left window casing 112. Likewise, the right first side 148 is secured to the right window casing 114 using right structure fastener 130 through right structure mounting hole 144 on the right non-conductive bracket 118 and into the right window casing 114. If flanged non-conductive seal 158 of FIG. 5 was used on the left and right non-conductive brackets 116, 118, then flanged non-conductive seal 158 covers the left and right structure fasteners 128, 130 so that the left and right structure fasteners 128, 130 are electrically insulated. If a sealer such as the flanged non-conductive seal 158 (FIG. 5) was not attached to the left and right non-conductive brackets 116, 118, then a seal such as the right non-conductive seal 122 and left non-conductive seal 120 is disposed directly on the each of the left and right non-conductive brackets 116, 118 so that left and right structure fasteners 128, 130 are covered and electrically insulated by left and right non-conductive seals 120, 122. The window well 110 is then moved so that the left window well flange 124 rests against the surface of either the left non-conductive seal 120 or the flanged non-conductive seal 158 of FIG. 5, depending upon which one was disposed on the left non-conductive bracket 116, and the right window well flange 126 rests against the surface of either right non-conductive seal 122 or flanged non-conductive seal 158 of FIG. 5, depending upon which one was disposed on the right non-conductive bracket 118. Left window well fastener 132 is then used to secure the left second side 138 through left window well mounting hole 142 of the left non-conductive bracket 116 and into the window well 110. Likewise, right window well fastener 134 is then used to secure the right second side 150 through right window well mounting hole 146 of the right non-conductive bracket 118 and into the window well 110. It is noted that both the left and right window well fasteners 132, 134 are used to secure the window well 110 in place from the area inside 152 of the window well 110. The clearance 172 is then filled with soil 170 or other landscaping and is compacted.

FIG. 7 is a top view of a window well 110 being installed using the window well mounting system 100 mounted directly to the foundation 108, and outside of left and right window well casings 112, 114. As previously discussed, window well mounting system 100 has left side 102 and right side 104. Similar to FIG. 6, window well 110 is installed by removing soil 170 (or other landscaping) to provide a clearance 172 for the window well 110 to be disposed in a position ready for mounting. Clearance 172 around the perimeter of the window well 110 is created wide enough to fit the left and right non-conductive brackets 116, 118 and so that there is space to secure the left and right structure fasteners 128, 130 on the left and right non-conductive brackets 116, 118. If a fitted type of seal is being used such as the flanged non-conductive seal 158 in FIG. 5, then the flanged non-conductive seal 158 should be disposed on the left first side 136 of the left non-conductive bracket 116, and the right first side 148 of the right non-conductive bracket 118. The left non-conductive bracket 116 is positioned so that the left first side 136 is against the surface of the foundation 108, and holes are drilled into the foundation 108 that align with each left structure mounting hole 140. The right non-conductive bracket 118 is positioned against the foundation 108, and holes are drilled into the foundation 108 that align with each right structure mounting hole 144. Left and right structure fasteners 128, 130 are then secured into each of left and right structure mounting holes 140, 144. It should be noted that the number of left and right structure mounting holes 140, 144 and the number of left and right structure fasteners 128, 130 can vary from a single structure mounting hole 140, 144 and a single structure fastener 128, 130 located approximately halfway down the depth of the window well, to multiple structure mounting holes 140, 144 and multiple structure fasteners 128, 130 used along the length of the window well depth. The left first side 136 is secured to the foundation 108 using left structure fastener 128 through left structure mounting hole 140 on the left non-conductive bracket 116 and into the foundation 108. Likewise, the right first side 148 is secured to the foundation 108 using right structure fastener 130 through right structure mounting hole 144 on the right non-conductive bracket 118 and into the foundation 108. If flanged non-conductive seal 158 of FIG. 5 was used on the left and right non-conductive brackets 116, 118, then flanged non-conductive seal 158 covers the left and right structure fasteners 128, 130 so that the left and right structure fasteners 128, 130 are electrically insulated. If a sealer such as the flanged non-conductive seal 158 (FIG. 5) was not attached to the left and right non-conductive brackets 116, 118, then a seal such as the right non-conductive seal 122 is disposed directly on each of the left and right non-conductive brackets 116, 118 so that left and right structure fasteners 128, 130 are covered and electrically insulated by left and right non-conductive seals 120, 122. The window well 110 is then moved so that the left window well flange 124 rests against the surface of either the left non-conductive seal 120 or the flanged non-conductive seal 158 (FIG. 5), depending upon which one was disposed on the left non-conductive bracket 116, and the right window well flange 126 rests against the surface of either right non-conductive seal 122 or flanged non-conductive seal 158 (FIG. 5) depending upon which one was disposed on the right non-conductive bracket 118. Left window well fastener 132 is then used to secure the left second side 138 through left window well mounting hole 142 of the left non-conductive bracket 116 and into the window well 110. Likewise, right window well fastener 134 is then used to secure the right second side 150 through right window well mounting hole 146 of the right non-conductive bracket 118 and into the window well 110. It is noted that both the left and right window well fasteners 132, 134 are used to secure the window well 110 in place from the area inside 152 of the window well 110. The clearance 172 is then filled with soil 170 or other landscaping and is compacted.

The window well mounting system 100 is versatile in that the system 100 can be used for various window widths, and window well 110 widths because the window well mounting system 100 can be mounted to various materials. For example, the window well mounting system 100 shown in FIG. 6 is mounted directly to left and right window well casings 112, 114. FIG. 7 illustrates the window well mounting system 100 secured directly to the foundation 108 outside the width of left and right window well casings 112, 114. The ability of the window well mounting system 100 to be secured to various materials is a benefit because installation of the window well 110 is not limited by window size as long as the window well is wide enough to at least reach the left and right window well casings 112, 114.

Figure 8:
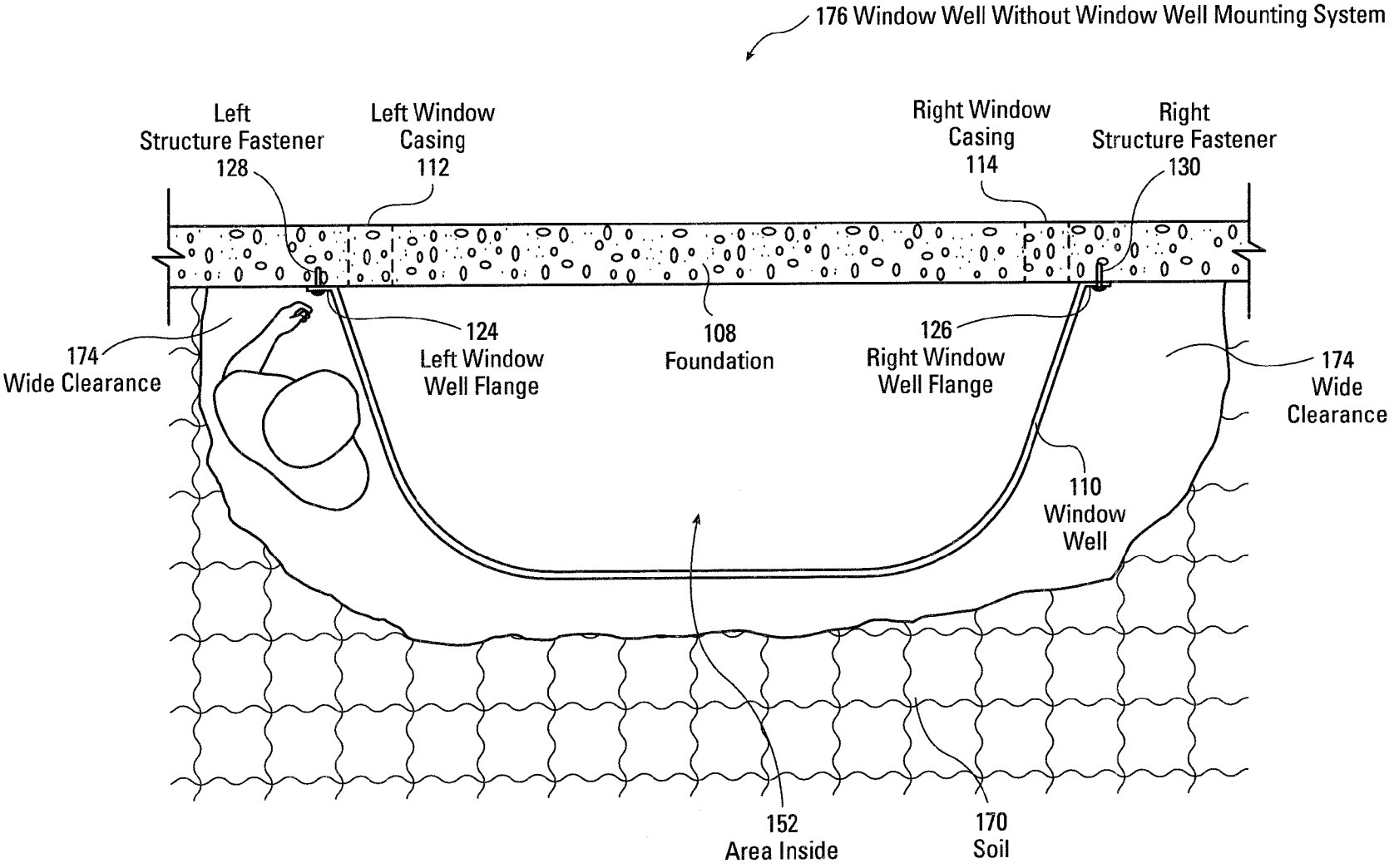
Fig. 8 (Prior Art)
FIG. 8 is a top view of another embodiment of a window well being installed.

FIG. 8 illustrates an installation of a window well without window well mounting system 176. FIG. 8 shows a wide clearance 174 being used by removing soil 170 (or other landscaping) to access fastening the left and right window well flanges 124, 126 to foundation 108 by using left and right structure fasteners 128, 130. As shown in FIG. 8, wide clearance 174 needs to be large enough so a person can fit behind the window well to secure left and right fasteners 128, 130. As discussed previously, if the metal window well 110 is in electrical contact with the foundation 108 and/or the Concrete-Encased Electrode, the window well 110 can oxidize prematurely, or if the metal window well 110 or the left and right structure fasteners 128, 130 going through window well 110 are in contact with the steel of the metal window buck or the steel reinforcing bar in the concrete, then moisture in contact with the two dissimilar metals/alloys can cause electrolysis, and current flowing through the connection can therefore cause premature oxidation of the window well 110. Often when an oxidized window well 110 needs to be replaced, it has been recommended to install a window well 110 that is wider than the existing window well 110 for the purpose of using a different mounting location in hopes that new left and right structure fasteners 128, 130 will not be electrically connected to the Concrete-Encased Electrode, metal window frame or metal window buck, and conductive components or dissimilar metals/alloy are not in contact. However, this often requires significantly disturbing the surrounding areas such as landscaping, concrete, and soil 170. Enough soil 170 must be removed around the existing window well to accommodate the larger window well 110 and a person to reach to the bottom of the window well to secure the left and right structure fasteners 128, 130 that are normally located on the outside of the window well. Creating such a wide clearance 174 around the window well, as shown in FIG. 8, can also require the removal of other structures/features, such as but not limited to a concrete patio, air conditioner, deck posts, or fencing. Using the system of the present invention, which allows the use of a replacement window well that is the same size as the existing window well allows the installer to remove the existing window well, such as by cutting out the existing window well using a reciprocal metal saw. The existing window well can then be removed and only two or three inches of dirt that surrounded the existing window well can then be easily removed using a landscaping bar or shovel to remove the two or three inches of dirt that surrounded the outside of the existing window well. The new window well can then be installed in the opening and connected using the insulated bracket system of the present invention. Since only a small amount of backfill needs to be removed, the replacement process may only take a few hours instead of days. Comparing FIGS. 6 and 7 to FIG. 8, it is apparent how much more of a wide clearance 174 is needed to install or replace window well 110. Clearance 172 shown in FIGS. 6 and 7 is much narrower because the same size window well can be used since the insulating brackets are used, which can be attached at any location on the foundation, metal window casing or metal window buck. In addition, the installer is not required to be on the outside of the window well 110. An installer can install window well 110 from an area inside 152 of the window well 110 using the window well mounting system 100. For replacement window wells, very little dirt needs to be removed since a same size window well can be installed since the connections to the foundation, window casing, or window buck do not have to be moved.

As discussed previously, the window well mounting system 100 (FIGS. 6 and 7) has left and right non-conductive brackets 116, 118 that are attached to the structure 106 and then left and right window well fasteners 132, 134 are then used to fasten window well 110 to the left and right non-conductive brackets 116, 118. In other words, all of the fasteners 128, 130, 132, 134 used in the window well mounting system 100 are attached by an installer that is in an area inside 152 window well. In contrast, installing or replacing a window well 110 as shown in FIG. 8 requires the installer to be inside of wide clearance 174 (outside of window well 110) to reach left and right structure fasteners 128, 130 located down towards the bottom of the window well 110. Therefore, window well mounting system 100 has many benefits which include minimal disruption of the area needed for clearance 172, installing a window well 110 that is versatile in width, can be connected to, or in contact with, a metal window buck or metal window casing, and the window well 110 being insulated from electric current to prevent premature oxidation of the window well 110.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of installing a window well mounting system comprising:

removing a portion of landscape from an area outside of a window well;

disposing said window well having a left window well flange and a right window well flange in front of said narrow portion of said landscape;

providing a left non-conductive bracket having a left first side with at least one left structure mounting hole and a left second side having at least one left window well mounting hole;

providing a right non-conductive bracket having a right first side with at least one right structure mounting hole and a right second side having at least one right window well mounting hole;

providing a left non-conductive seal;

providing a right non-conductive seal;

positioning said left first side of said left non-conductive bracket to a structure to be mounted so that said left second side of said left non-conductive bracket protrudes from said left first side of said left non-conductive bracket in a direction away from said structure and into an area inside said window well;

drilling at least one hole through said structure that is aligned with said at least one left structure mounting hole of said left non-conductive bracket on said left first side of said left non-conductive bracket;

positioning said right first side of said right non-conductive bracket to said structure to be mounted so that said right second side of said right non-conductive bracket protrudes from said right first side of said right non-conductive bracket in a direction away from said structure and into said area inside said window well, and said right non-conductive bracket being a distance from said left non-conductive bracket so that said left flange of said window well aligns with said left first side of said left non-conductive bracket and said right flange of said window well aligns with said right first side of said right non-conductive bracket;

securing said left first side of said left non-conductive bracket to said structure with at least one left structure fastener by disposing said at least one left fastener through said at least one left structure mounting hole and into said structure;

securing said right first side of said right non-conductive bracket to said structure with at least one right structure fastener by disposing said at least one right fastener through said at least one right structure mounting hole and into said structure;

insulating said at least one left structure fastener from conducting electricity to said window well by securing said left non-conductive seal to said left first side of said left non-conductive bracket;

insulating said at least one right structure fastener from conducting electricity to said window well by securing said right non-conductive seal to said right first side of said right non-conductive bracket;

aligning said left window well with said left non-conductive bracket;

aligning said right window well with said right non-conductive bracket;

securing said window well to said left second side of said left non-conductive bracket by disposing said at least one left structure fastener through said at least one left window well mounting hole from an area inside said window well and through said window well;

securing said window well to said right second side of said right non-conductive bracket by disposing said at least one right structure fastener through said at least one right window well mounting hole from said area inside said window well.

2. The method of claim 1 wherein securing said left non-conductive seal to said left first side of said left non-conductive bracket is before securing said left first side of said left non-conductive bracket to said structure, and securing said right non-conductive seal to said right first side of said right non-conductive bracket is before securing said right first side of said right non-conductive bracket to said structure.

3. The method of claim 2 wherein securing said left non-conductive seal to said left first side of said left non-conductive bracket comprises sandwiching a longitudinal edge of said left first side of said left non-conductive bracket between a first flange and a second flange of said left non-conductive seal.

4. The method of claim 2 wherein securing said right non-conductive seal to said right first side of said right non-conductive bracket comprises sandwiching a longitudinal edge of said right first side of said right non-conductive bracket between a first flange and a second flange of said right non-conductive seal.

5. The method of claim 1 wherein securing said left non-conductive seal to said left first side of said left non-conductive bracket is after securing said left first side of said left non-conductive bracket to said structure, and securing said right non-conductive seal to said right first side of said right non-conductive bracket is after securing said right first side of said right non-conductive bracket to said structure.

6. The method of claim 1 wherein drilling at least one hole through said structure is drilling through a foundation.

7. The method of claim 1 wherein drilling at least one hole through said structure is drilling through a window casing.

8. A window well mounting system comprising:

a left non-conductive bracket having a left first side with at least one left structure mounting hole, and a left second side with at least one left window mounting hole, and wherein said left second side of said left non-conductive bracket protrudes from said left first side of said left non-conductive bracket towards an area inside of said window well;

a right non-conductive bracket having a right first side with at least one right structure mounting hole, and a right second side with at least one right window mounting hole, and wherein said right second side of said right non-conductive bracket protrudes from said right first side of said right non-conductive bracket towards said area inside of said window well;

at least one left structure fastener disposed through said at least one left structure mounting hole and into a structure;

at least one right structure fastener disposed through said at least one right structure mounting hole and into said structure;

a left non-conductive seal disposed on said left first side of said left non-conductive bracket;

a right non-conductive seal disposed on said right first side of said right non-conductive bracket;

at least one left window well fastener disposed through said at least one left window well mounting hole from an area inside said window well and into said window well;

at least one right window well fastener disposed through said at least one right window well mounting hole from an area inside said window well and into said window well.

9. The window well mounting system of claim 8 further comprises said left non-conductive seal being a flanged non-conductive seal having a first flange and a second flange spaced apart and configured to sandwich said left first side of said left non-conductive bracket along a longitudinal edge of said left first side of said left non-conductive bracket.

10. The window well mounting system of claim 8 further comprises said right non-conductive seal being a flanged non-conductive seal having a first flange and a second flange spaced apart and configured to sandwich said first side of said right non-conductive bracket along a longitudinal edge of said right first side of said right non-conductive bracket.

11. The window well mounting system of claim 8 further comprises said at least one left structure fastener disposed through said at least one left structure mounting hole and into a foundation of said structure, and said at least one right structure fastener disposed through said at least one right structure mounting hole and into said foundation of said structure.

12. The window well mounting system of claim 8 further comprises said at least one left structure fastener disposed through said at least one left structure mounting hole and into a left window casing of said structure, and said at least one right structure fastener disposed through said at least one right structure mounting hole and into a right window casing of said structure.

* * * * *